US011293449B2

(12) United States Patent
Chang

(10) Patent No.: US 11,293,449 B2
(45) Date of Patent: Apr. 5, 2022

(54) PORTABLE BLOWING DEVICE

(71) Applicant: Po-Chun Chang, Taipei (TW)

(72) Inventor: Po-Chun Chang, Taipei (TW)

( * ) Notice: Subject to any disclaimer, the term of this patent is extended or adjusted under 35 U.S.C. 154(b) by 219 days.

(21) Appl. No.: 16/630,413

(22) PCT Filed: Jul. 9, 2018

(86) PCT No.: PCT/CN2018/094973
§ 371 (c)(1),
(2) Date: Jan. 10, 2020

(87) PCT Pub. No.: WO2019/011211
PCT Pub. Date: Jan. 17, 2019

(65) Prior Publication Data

US 2020/0141047 A1 May 7, 2020

Related U.S. Application Data

(60) Provisional application No. 62/530,403, filed on Jul. 10, 2017.

(51) Int. Cl.

| | |
|---|---|
| ***F04D 25/08*** | (2006.01) |
| ***A47G 25/28*** | (2006.01) |
| ***F04D 25/06*** | (2006.01) |
| ***D06F 58/00*** | (2020.01) |

(52) U.S. Cl.
CPC ..... *F04D 25/088* (2013.01); *A47G 25/28* (2013.01); *D06F 58/00* (2013.01); *F04D 25/0693* (2013.01)

(58) Field of Classification Search
CPC ..... F04D 25/088; F04D 25/0693; F04D 25/0673; F04D 25/084; F04D 29/601; D06F 58/00; D06F 59/02; A47G 25/28; A47G 25/0692; B05B 7/0081; A47F 3/0434; A47F 7/00; A47F 3/0486; G09F 23/06
See application file for complete search history.

(56) References Cited

U.S. PATENT DOCUMENTS

| | | | | | |
|---|---|---|---|---|---|
| 1,833,631 | A * | 11/1931 | Wilsey | D06F 58/14 | 34/233 |
| 3,626,602 | A * | 12/1971 | Glowacki | D06F 57/04 | 34/622 |
| D357,608 | S * | 4/1995 | Todd, Jr. | D6/673 | |
| 6,047,482 | A * | 4/2000 | Roper | D06F 58/00 | 34/106 |
| 7,374,138 | B2 * | 5/2008 | Marshall | A47F 7/00 | 108/49 |
| 8,789,729 | B2 * | 7/2014 | Beckett | D06F 59/02 | 223/88 |

(Continued)

*Primary Examiner* — Ko H Chan
(74) *Attorney, Agent, or Firm* — Chun-Ming Shih; HDLS IPR Services

(57) ABSTRACT

A portable blowing device includes at least one support rod and a plurality of blades. The support rod comprises an upper rod portion, a lower rod portion, and a rotating ring that is located between the upper rod portion and the lower rod portion. A hook is disposed on the top end of the upper rod portion, and pluralities of first fixed portions are disposed on the outer surface of the rotating ring. Each blade has a first connection portion for connecting to the corresponding first fixed portion of the rotating ring. When the blowing device is activated, the rotation of blades generates the airflow to blow user or the clothes hung on a support frame.

11 Claims, 15 Drawing Sheets

(56) References Cited

U.S. PATENT DOCUMENTS

| | | | | |
|---|---|---|---|---|
| 9,803,314 | B1 * | 10/2017 | Zupnick | F26B 9/003 |
| 10,900,494 | B2 * | 1/2021 | Holder | F21V 33/0096 |
| 2006/0226177 | A1 * | 10/2006 | McJunkin | D06F 59/02 223/85 |
| 2007/0164062 | A1 * | 7/2007 | Clopton | D06F 59/02 223/85 |
| 2009/0083989 | A1 * | 4/2009 | Wang | D06F 59/02 34/442 |
| 2016/0201254 | A1 * | 7/2016 | Song | D06F 59/02 68/6 |
| 2016/0338519 | A1 * | 11/2016 | Singleton | A47G 25/0692 |

* cited by examiner

PORTABLE BLOWING DEVICE

REFERENCE TO RELATED APPLICATIONS

This application is a continuation of International Application No. PCT/CN2018/094973, filed Jul. 9, 2018, which claims the benefit of U.S. Provisional Application No. 62/530,403, filed Jul. 10, 2017, the disclosure of which is fully incorporated herein by reference.

FIELD OF THE INVENTION

The invention relates to a blowing device, in particular to a portable blowing device.

BACKGROUND

Travelers often hang their washed clothes in the bathroom or in the guest room of the hotel to dry their clothes. However, the bathroom or the guest room tends to be damp and not convective enough to make clothes not dry easily. Thus, travelers may often wear wet clothes and cause inconvenience in travel.

Thus, the present invention provides an innovative blowing device that is convenient for the travelers to carry and is suitable for use in various places, whereby the travelers can quickly blow and dry the clothes by using the blowing device while traveling to increase convenience in travel.

SUMMARY

An object of the present invention is to provide a blowing device comprising at least one support rod and a plurality of blades. The support rod includes an upper rod portion, a lower rod portion and a rotating ring that is located between the upper rod portion and the lower rod portion, wherein the top end of the upper rod portion is connected to a hook or a clip. The blades are connected to the rotating ring, and rotate with the rotating ring relative to the upper rod portion and the lower rod portion to generate airflow.

Another object of the present invention is to provide a blowing device, which is provided with at least one support frame on the lower rod portion of the support rod to hang clothes, shoes, socks or towels. When the blowing device is activated, the blades will rotate with the rotating ring to generate the airflow to blow clothes, shoes, socks or towels placed on the support frame to reduce the time of dry clothes, shoes, socks or towels.

Another object of the present invention is to provide a blowing device. The user can select an appropriate support frame according to clothes, shoes, socks or towels to be dried, and install the selected support frame on the support rod. The blades of the blowing device can generate the airflow to blow the clothes, shoes, socks or towels hung on the support frame and dry the clothes, shoes, socks or towels.

Another object of the present invention is to provide a blowing device that is easily to be carried, assembled and disassembled by the user. Thus, the user can carry the blowing device while traveling, and can assemble the blowing device at any time or place to generate the airflow to blow the clothes to improve the convenience in use.

The present invention provides a portable blowing device, comprises at least one support rod including an upper rod portion, a rotating ring and a lower rod portion, one end of the upper rod portion being connected with a hook or a clip, the rotating ring located between the upper rod portion and the lower rod portion, a plurality of first fixed portions being disposed on an outer surface of the rotating ring, and a housing space located in the lower rod portion for containing a battery unit; and a plurality of blades connected with the rotating ring, wherein one end of each blade has a first connection portion for connecting to the first fixed portion of the rotating ring.

In one embodiment of the blowing device, comprises a plurality of support frames having a second connection portion disposed on one end thereof, and an outer surface of the lower rod portion having a plurality of second fixed portions for connecting to the second connection portion of the support frames respectively.

In one embodiment of the blowing device, the support frame is a flat cuboid, and a plurality of grooves are located on a top surface of the support frame, or a plurality of through holes are located on a side surface of the support frame.

In one embodiment of the blowing device, the other end of each the support frame comprises a connection recess or a connection projection for connecting to a support frame of another blowing device via the connection recess or the connection projection.

In one embodiment of the blowing device, the lower rod portion of the support rod connects with two the support frames to form a hanger.

In one embodiment of the blowing device, comprises an arcuate auxiliary support frame having a third connection portion at one end thereof, the third connection portion of the arcuate auxiliary support frame being connected to one of the second fixing portions of the lower rod portion, and angles between the arcuate auxiliary support frame and the two support frames being the same.

In one embodiment of the blowing device, the support frame is a U-shaped support frame.

In one embodiment of the blowing device, comprises a plurality of arc-shaped support frames having at least one second connection portion disposed on an inner surface thereof for connecting with at least one second fixed portion located on an outer surface of the lower rod portion, and connecting to at least one rod-shaped frame via an outer surface thereof, wherein one end of the rod-shaped frame is connected to the outer surface of the arc-shaped support frames, and the other end of the rod-shaped frame is provided with an protruding stop portion.

In one embodiment of the blowing device, the first connection portion connects to the blades via a rotating shaft.

In one embodiment of the blowing device, comprises a through hole disposed on the lower rod portion of the support rod, and a protruding button disposed on the battery unit, wherein the battery unit is located in the housing space of the lower rod portion, and the protruding button is locked in the through hole.

In one embodiment of the blowing device, the battery unit is a rechargeable battery.

In one embodiment of the blowing device, the battery unit is a carbon zinc battery, an alkaline battery or a disposable battery.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

Figure 1:
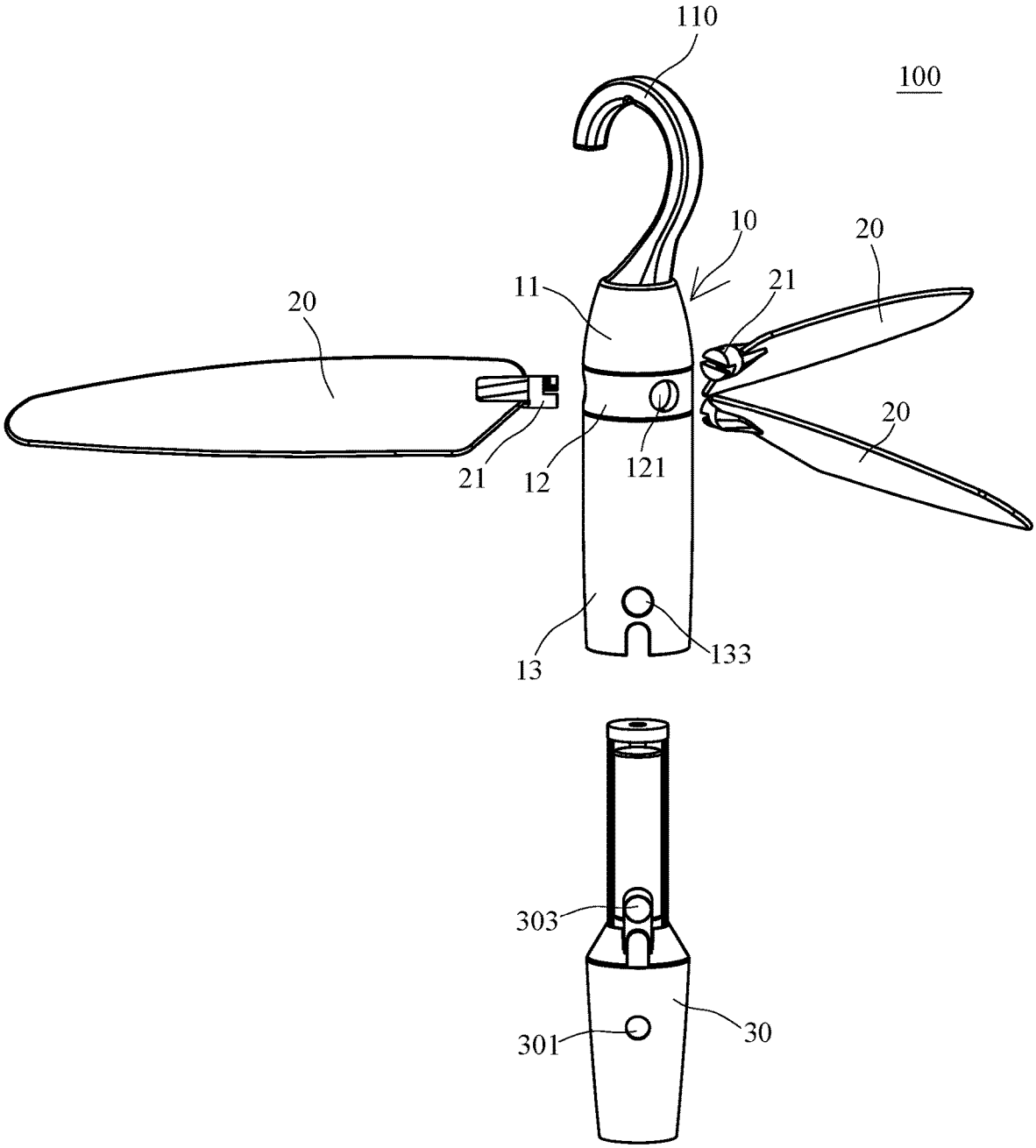
FIG. 1 is a perspective exploded view of a blowing device according to an embodiment of the invention.
Figure 2:
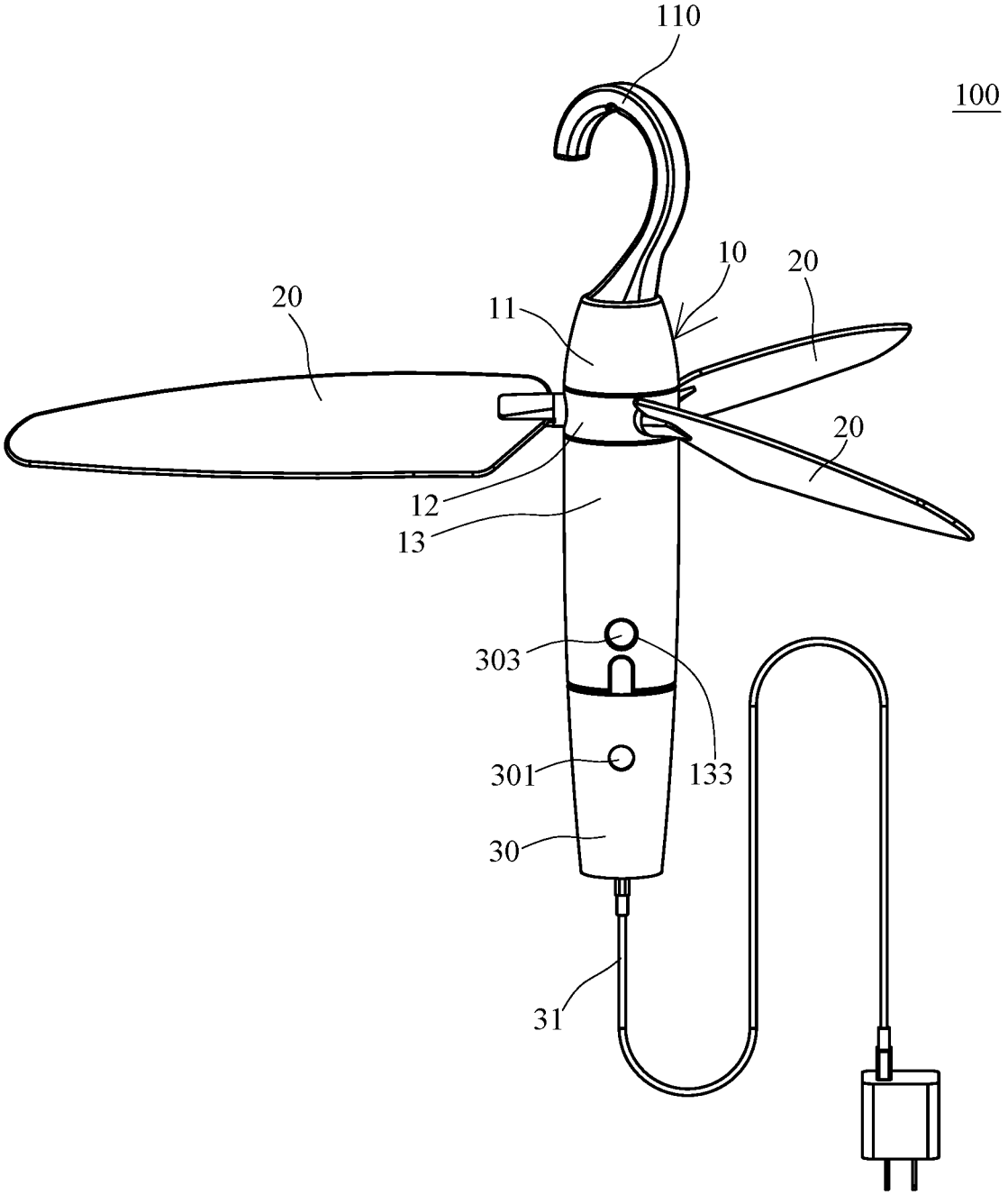
FIG. 2 is a perspective view of a blowing device according to an embodiment of the invention.

Please refer to FIG. 1 and FIG. 2, which are respectively a perspective exploded view and a perspective view of a blowing device according to an embodiment of the invention. The blowing device 100 includes at least one support rod 10, a plurality of blades 20 and a battery unit 30. The support rod 10 includes an upper rod portion 11, a rotating ring 12 and a lower rod portion 13, wherein one end, such as top end, of the upper rod portion 11 is connected to a hook 110 or a clip, and the other end of the upper rod portion 11 is connected to the rotating ring 12. More specifically, the rotating ring 12 is located between the upper rod portion 11 and the lower rod portion 13, and is rotatable relative to the upper rod portion 11 and the lower rod portion 13. A plurality of first fixing portions 121 are disposed on the outer surface of the rotating ring 12, and a bottom end or a side surface of the lower rod portion 13 may have a hollow housing space.

The battery unit 30 is used to provide a driving power to the blowing device 100 for driving the rotating ring 12 to rotate. In one embodiment of the invention, the battery unit 30 may include a protruding button 303, and the housing space of the lower rod portion 13 may include a through hole 133. When the battery unit 30 is disposed in the housing space from the bottom end of the lower rod portion 13, the protruding button 303 of the battery unit 30 will be fitted and locked in the through hole 133 to fix the battery unit 30 to the lower rod portion 13 of the support rod 10. Further, the user can press the protruding button 303 to unlock the protruding button 303 from the through hole 133, and then the battery unit 30 can be detached from the lower rod portion 13 of the support rod 10. In other embodiment of the invention, the battery unit 30 may be fixed to the lower rod portion 13 of the support rod 10 through a locking assembly or a snap assembly, and thus the protruding button 303 and the through hole 133 are not limitation of the scope of the invention. In one embodiment of the invention, the battery unit 30 may be a carbon zinc battery, an alkaline battery or other disposable battery. In other embodiment of the present invention, the battery unit 30 may be a rechargeable battery, such as a lithium battery. When the battery unit 30 is a rechargeable battery, the battery unit 30 may be connected and charged via a USB cable 31, a solar panel or a wireless coil.

Further, a motor (not shown) may be disposed within the upper rod portion 11 and/or the lower rod portion 13 of the support rod 10. Specifically, the motor may include a stator and a rotor, wherein the stator is fixed to the upper rod portion 11 and/or the lower rod portion 13, and the rotor is coupled to the rotating ring 12. When the battery unit 30 drives the operation of the motor, the rotating ring 12 will rotate relative to the upper rod portion 11 and the lower rod portion 13.

One end of the blade 20 may be provided with a first connection portion 21 that can be connected with the first fixed portion 121 of the rotating ring 12. In one embodiment, the first fixed portion 121 may be a fixed hole, and the first connection portion 21 may be a projecting unit that is able to be inserted into the fixed hole for connection of the blades 20 and the rotating ring 12. In another embodiment of the invention, the first fixing portion 121 may be a bolt, and the first connection portion 21 may be a nut that can be locked to the bolt.

In actual application, the blowing device 100 can be hung on a fixed object (not shown), such as a rope or a fixed rod, via the hook 110 or the clip. The rotation of the blade 20 is able to generate the airflow to blow the user or the clothes.

In addition, the blades 20 of the blowing device 100 may be detached from the support rod 10 to facilitate the user to store the battery unit 30, the support rod 10 and the blades 20 in the luggage bag and carry the blowing device 100.

Figure 3:
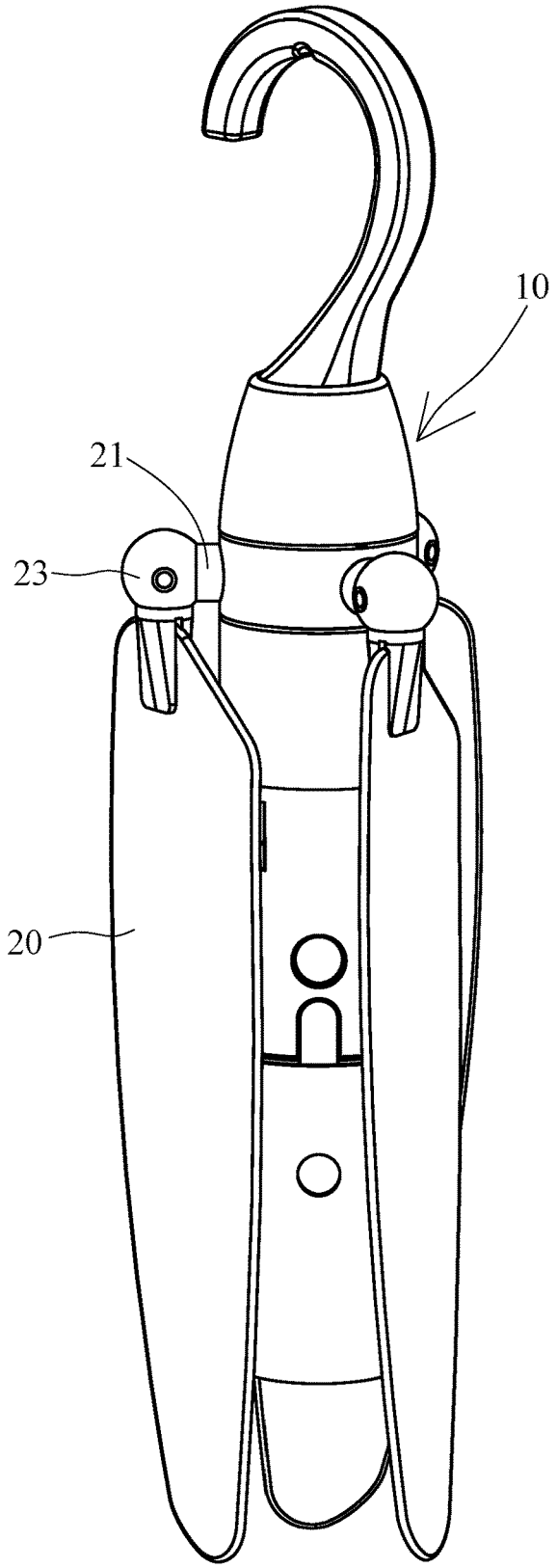
FIG. 3 is a perspective view of folded blades of a blowing device according to another embodiment of the invention.

In another embodiment of the invention, as shown in FIG. 3, the first connection portion 21 may be connected to one end of the blade 20 via a rotating shaft 23, so that the blade 20 can be rotated or folded on the rotating shaft 23 relative to the support rod 10 and/or the first connection portion 21. Thereby, the user only needs to fold or rotate the blades 20 relate to the rotating ring 12 for storage of the blowing device 100 without removing the blades 20 from the support rod 10.

Figure 4:
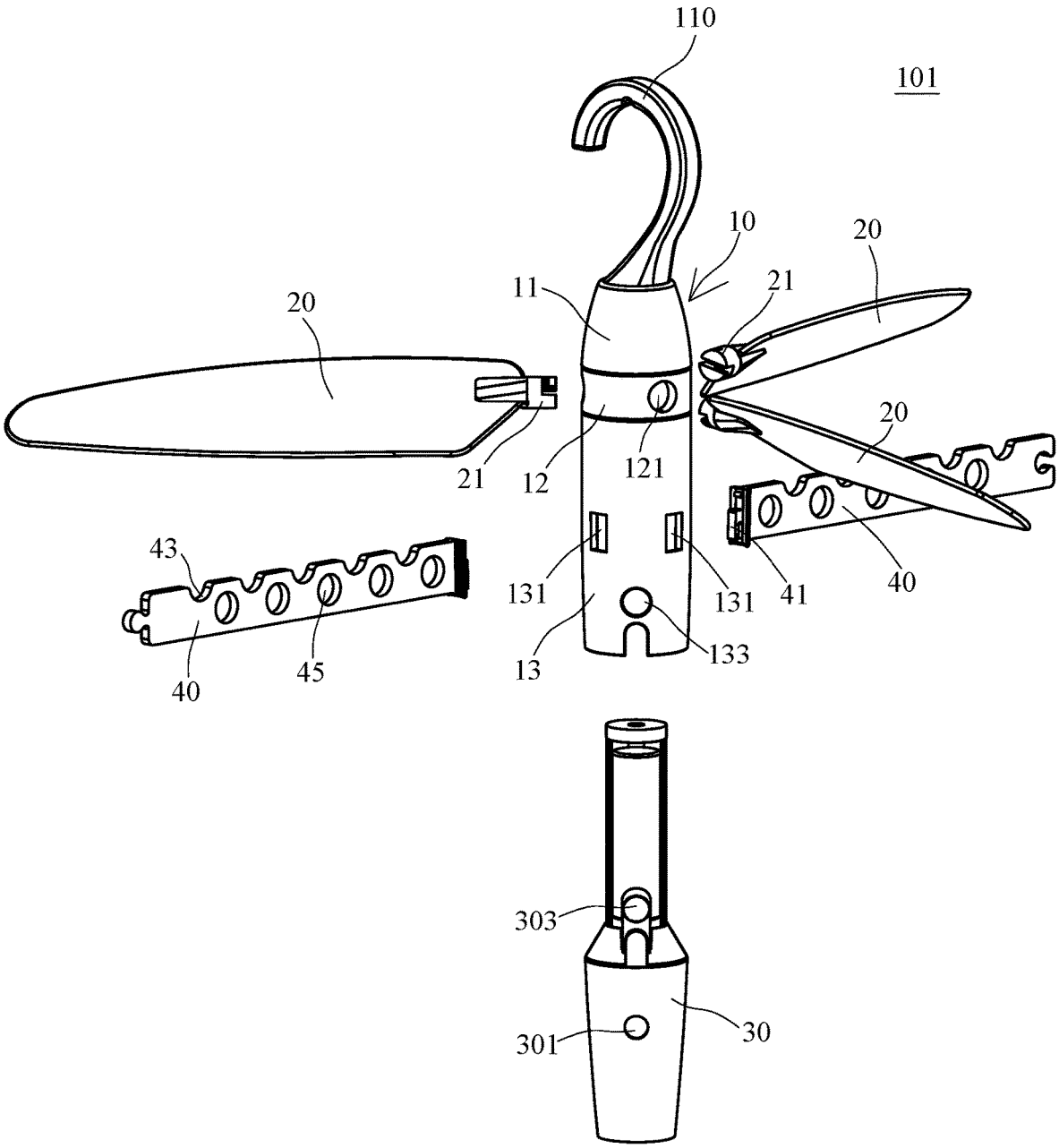
FIG. 4 is a perspective exploded view of a blowing device according to another embodiment of the invention.
Figure 5:
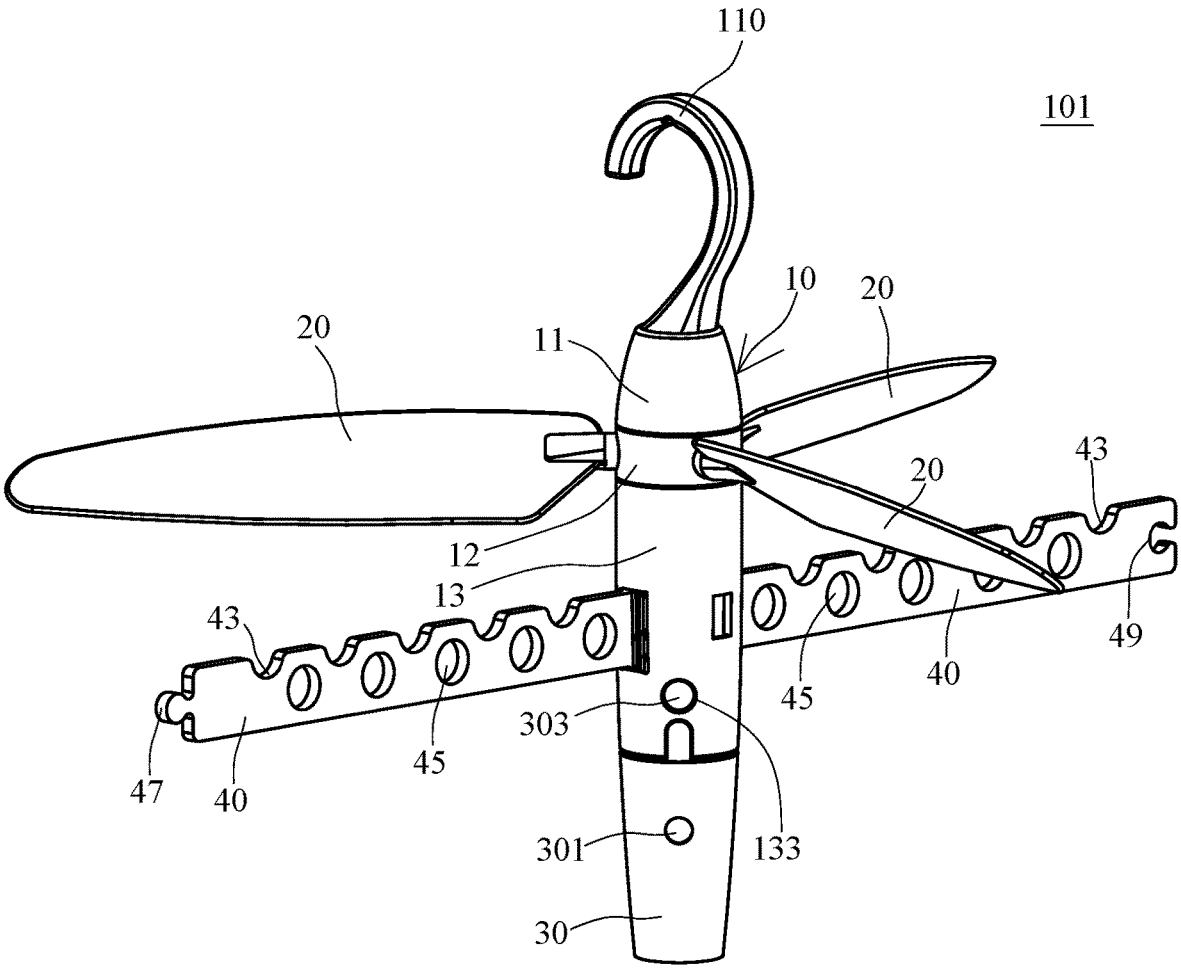
FIG. 5 is a perspective view of a blowing device according to another embodiment of the invention.

Please refer to FIG. 4 and FIG. 5, which are respectively a perspective exploded view and a perspective view of the blowing device according to another embodiment of the invention. The blowing device 101 of the embodiment further includes at least one support frame 40, wherein the shape of the support frame 40 may be an elongated or flat cuboid. One end of the support frame 40 is provided with a second connection portion 41, and an outer surface of the lower rod portion 13 is provided with a plurality of second fixed portions 131 that can be connected with the second connection portion 41 of the support frames 40 respectively. In this embodiment, the second fixed portion 131 may be a fixing hole, and the second connection portion 41 may be a projecting head that can be inserted into the fixing hole. In addition, a plurality of grooves 43 may be disposed on a top surface, such as the long edge of the support frame 40, or a plurality of through holes 45 may be disposed on a side surface of the support frame 40.

Figure 6:
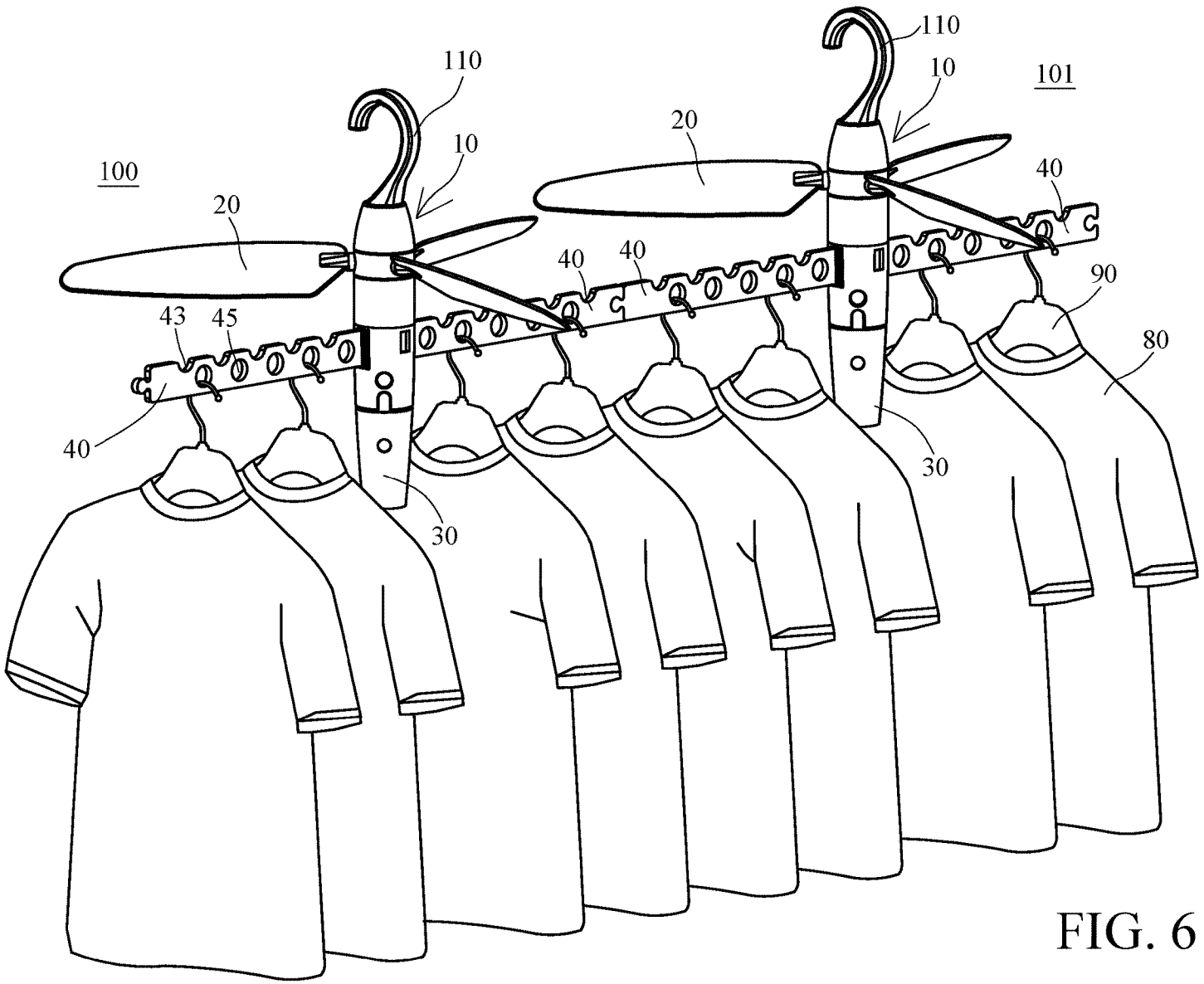
FIG. 6 is a perspective view of a blowing device according to another embodiment of the invention.

In actual application, as shown in FIG. 6, the clothes 80 can be put on the hanger 90 that is hung on the groove 43 or the through hole 45 of the support frame 40. The user can press the power button 301 of the battery unit (unit) 30, and activate the blades 20 and rotating ring 12 of the blowing device 101 to rotate relative to the upper rod portion 11 and the lower rod portion 13 to generate the airflow to blow the clothes 80 and reduce the time of dry clothes.

In addition, the user may connect a plurality of blowing devices 100/101 in series. Specifically, each of the blowing devices 100/101 can connect one end of two or more support frames 40, and the other end of the two or more support frames 40 may have a connection projection 47 or a connection recess 49. The connection projection 47 of the support frame 40 of the blowing device 101 may be connected to the connection recess 49 of the support frame 40 of another blowing device 100. Through the connection of multiple blowing devices 100/101, a larger number of hangers 90 and/or clothes 80 can be hung on the support frame 40. In the embodiment of the invention, two blowing devices 100/101 are connected in series via the support frames 40. Further, the number of blowing devices 100/101 connected in series may be more than two in other embodiment.

The blades 20 and the support frame 40 may be detached from the support rod 10, and the battery unit 30, the support rod 10, the blades 20 and the support frame 40 can be stored in a luggage bag, so as to facilitate the user to carry the blowing device 100/101. Further, the blades 20 may be connected to the first connection portion 21 via the rotating shaft 23, and the user can fold or rotate the blades 20 relate to the rotating ring 12 for storage of the blowing device 100/101.

Figure 7:
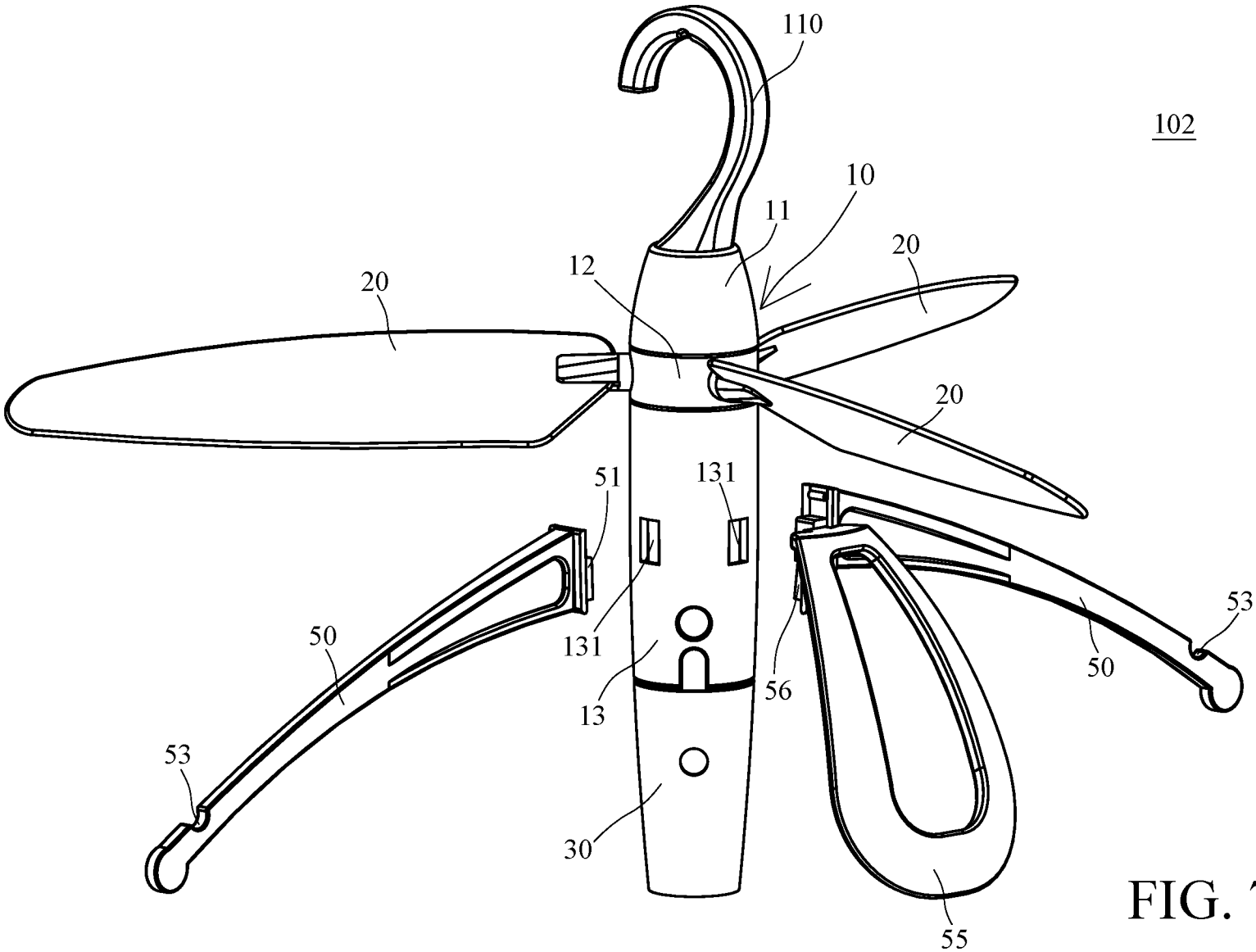
FIG. 7 is a perspective exploded view of support frames of a blowing device according to another embodiment of the invention.
Figure 8:
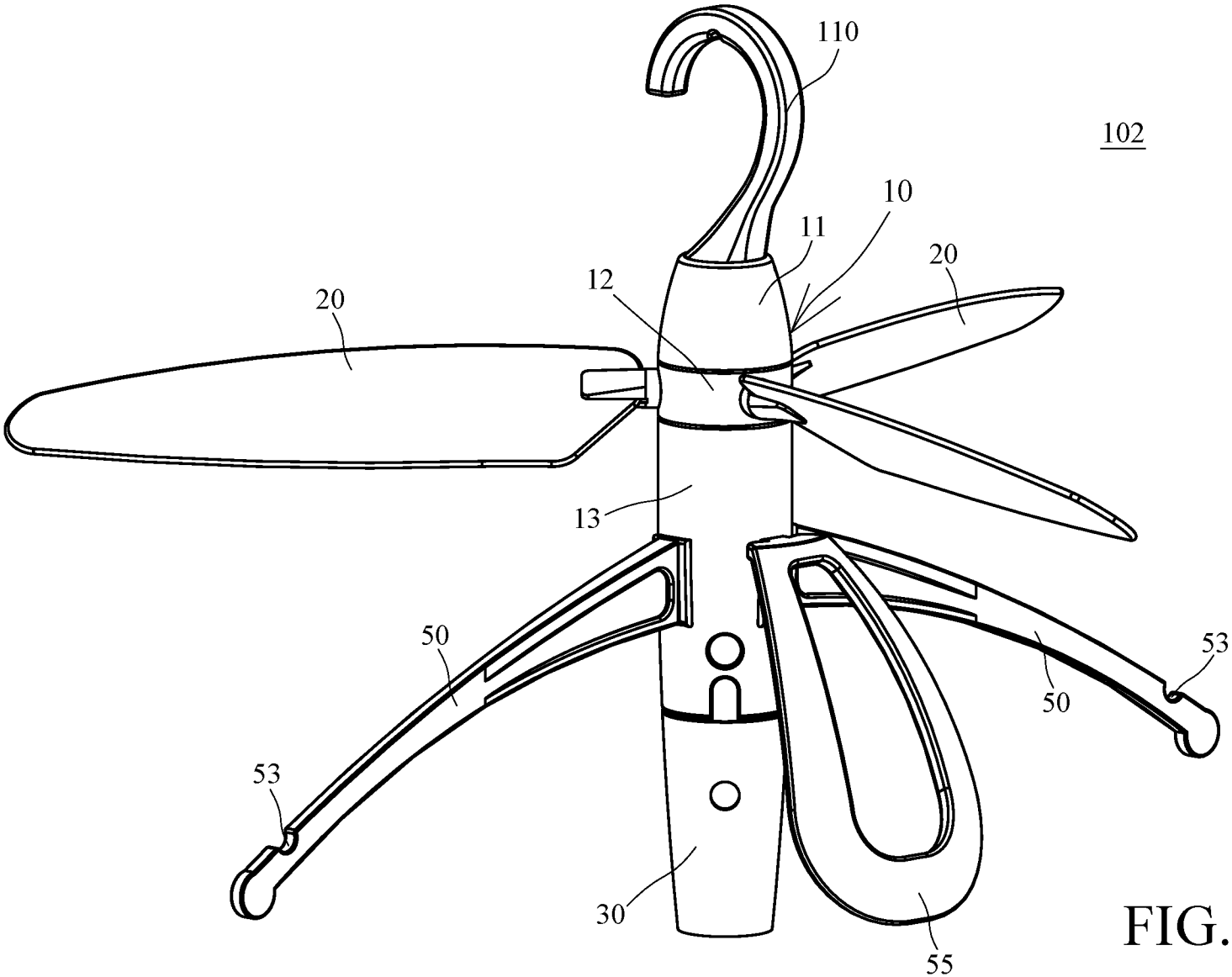
FIG. 8 is a perspective view of a blowing device according to another embodiment of the invention.
Figure 9:
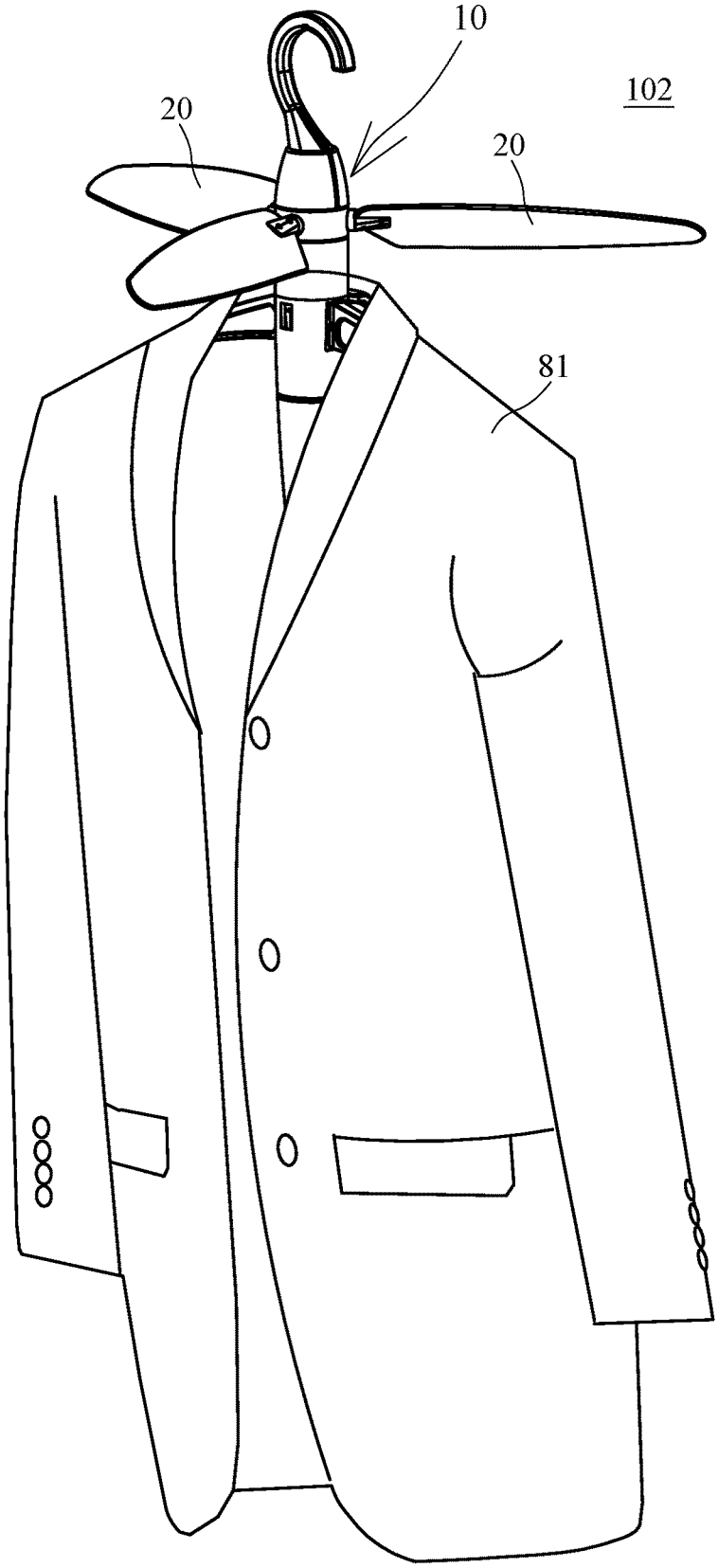
FIG. 9 is a use diagram of a blowing device according to another embodiment of the invention.

Please refer to FIG. 7, FIG. 8 and FIG. 9, which are respectively a perspective exploded view of support frames of a blowing device, a perspective view and a use diagram of a blowing device according to another embodiment of the invention. In one embodiment of the invention, the lower rod portion 13 of the support rod 10 of the blowing device 102 may be provided with two elongated support frames 50. One end of the support frames 50 has a second connection portion 51 and the other end of the support frames 50 has a non-skid portion 53. For example, the support frame 50 may be arc shape, and the second connection portion 51 may be a projecting head. Further, the second connection portions 51 of the two support frames 50 can be respectively inserted into the second fixed portions 131 of the lower rod portion 13. For example, the angle between the two support frames 50 is about 180 degrees, so that two support frames 50 forms a hanger-like configuration, and the clothes 81 can be hung on the two support frames 50. The blades 20 of the blowing device 102 can rotate to generate airflow to blow the clothes 81 on the support frame 50 to reduce the time of dry clothes.

The blowing device 102 may further include an arcuate auxiliary support frame 55, wherein one end of the arcuate auxiliary support frame 55 has a third connection portion 56, such as a fitting head, for inserting into one of the second fixed portions 131 of the lower rod portion 13. Specifically, the angles between the arcuate auxiliary support frame 55 disposed on the lower rod portion 13 and the two support frames 50 are the same, so that the two support frames 50 are symmetrically disposed on both sides of the arcuate auxiliary support frame 55. When the clothes 81 are hung on the two support frames 50, the arcuate auxiliary support 55 will separate the front and rear fabrics of the clothes 81 to improve the efficiency of drying the clothes 87.

The blades 20, the two support frames 50 and the arcuate auxiliary support frame 55 may be detached from the support rod 10, and the battery unit 30, the support rod 10, the blades 20, the support frame 50 and the arcuate auxiliary support frame 55 may be stored in the luggage bag. In other embodiment, the blades 20 may be connected to the first connection portion 21 via the rotating shaft 23, and the user can fold or rotate the blades 20 relate to the rotating ring 12 for storage of the blowing device 100/101.

Figure 10:
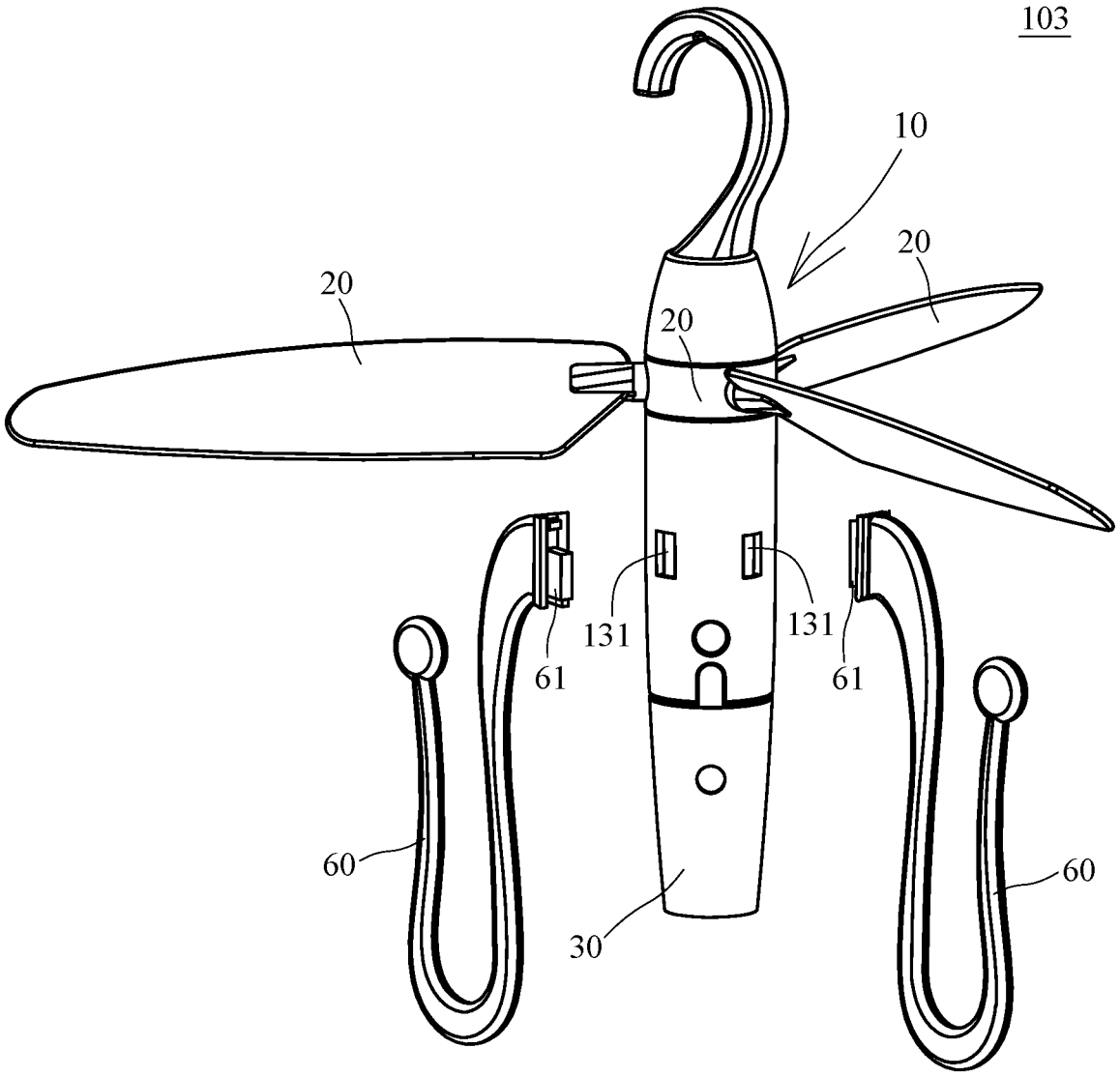
FIG. 10 is a perspective exploded view of support frames of a blowing device according to another embodiment of the invention.
Figure 11:
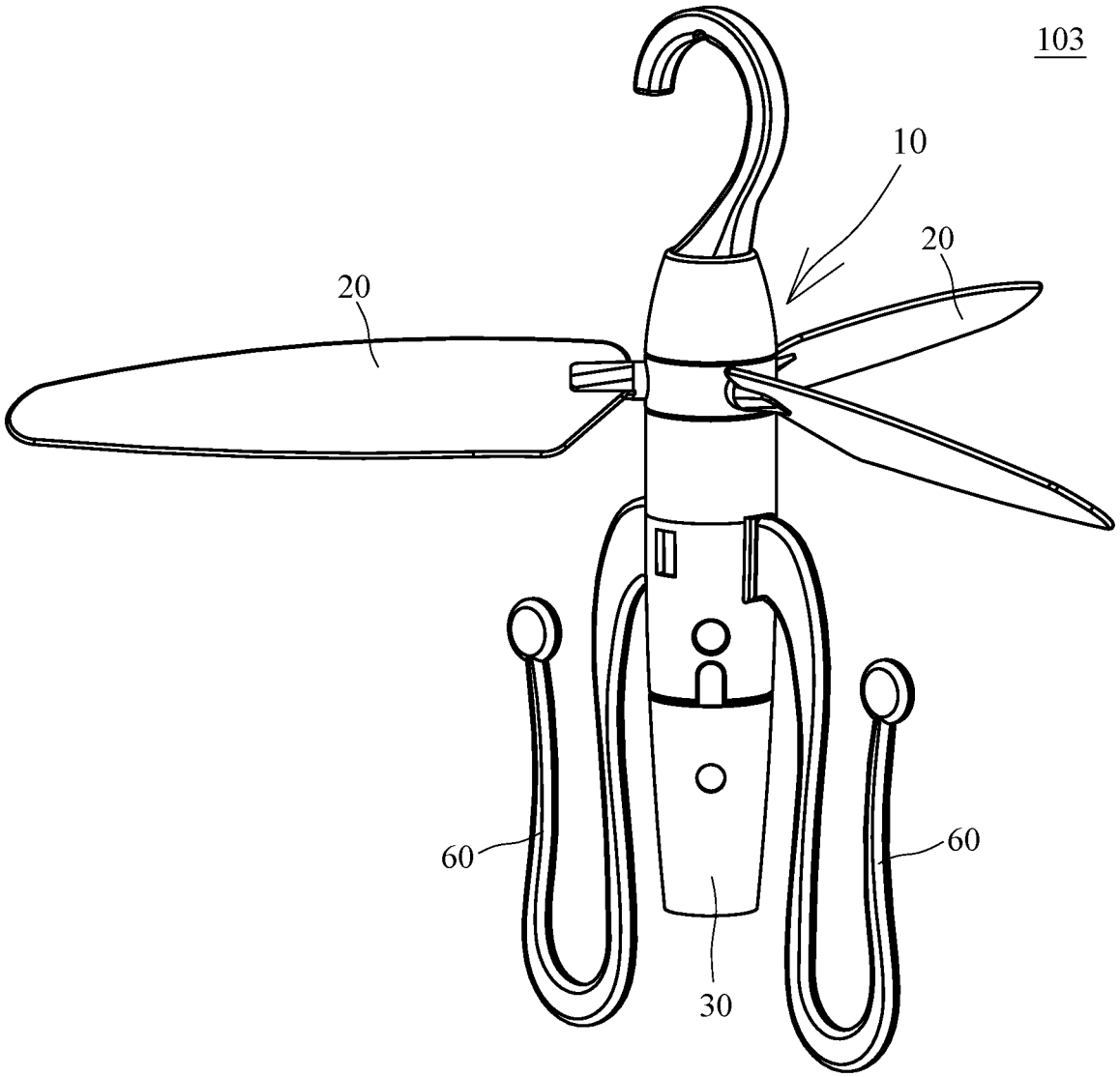
FIG. 11 is a perspective view of a blowing device according to another embodiment of the invention.
Figure 12:
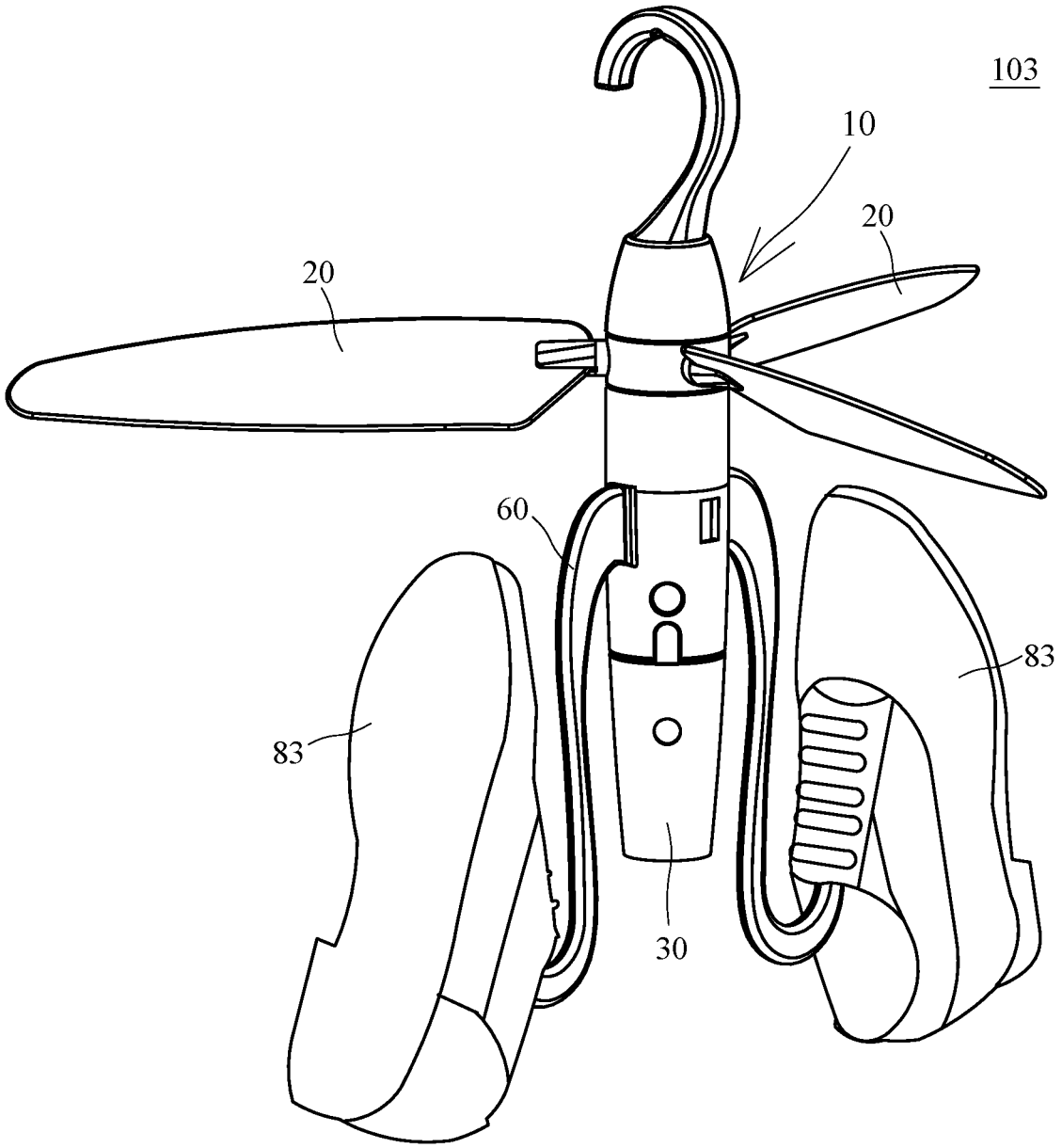
FIG. 12 is a use diagram of a blowing device according to another embodiment of the invention.

Please refer to FIG. 10, FIG. 11 and FIG. 12, which are respectively a perspective exploded view of support frames of a blowing device, a perspective view and a use diagram of a blowing device according to another embodiment of the invention. The blowing device of the present invention may be used to blow and dry shoes or socks. The support frame 60 of the blowing device 103 may be a U-shaped support frame, wherein one end of the support frame 60 has a second connection portion 61, such as a projecting head, for inserting into the second fixed portion 131 of the lower rod portion 13, and the other end of the support frame 60 may be used to hang the shoes 83 or the sock. The blades 20 of the blowing device 103 can generate the airflow to blow the shoes 83 or the sock on the support frame 60 to reduce time of dry the shoes 83 or the sock.

The blades 20 and the support frame 60 of the blowing device 103 can be detached from the support rod 10, and the battery unit 30, the support rod 10, the blades 20 and the support frame 60 may be stored in the luggage bag. In other embodiment, the blades 20 may be connected to the first connection portion 21 via the rotating shaft 23, and the user can fold or rotate the blades 20 relate to the rotating ring 12 for storage of the blowing device 103 without removing the blades 20 from the support rod 10.

Figure 13:
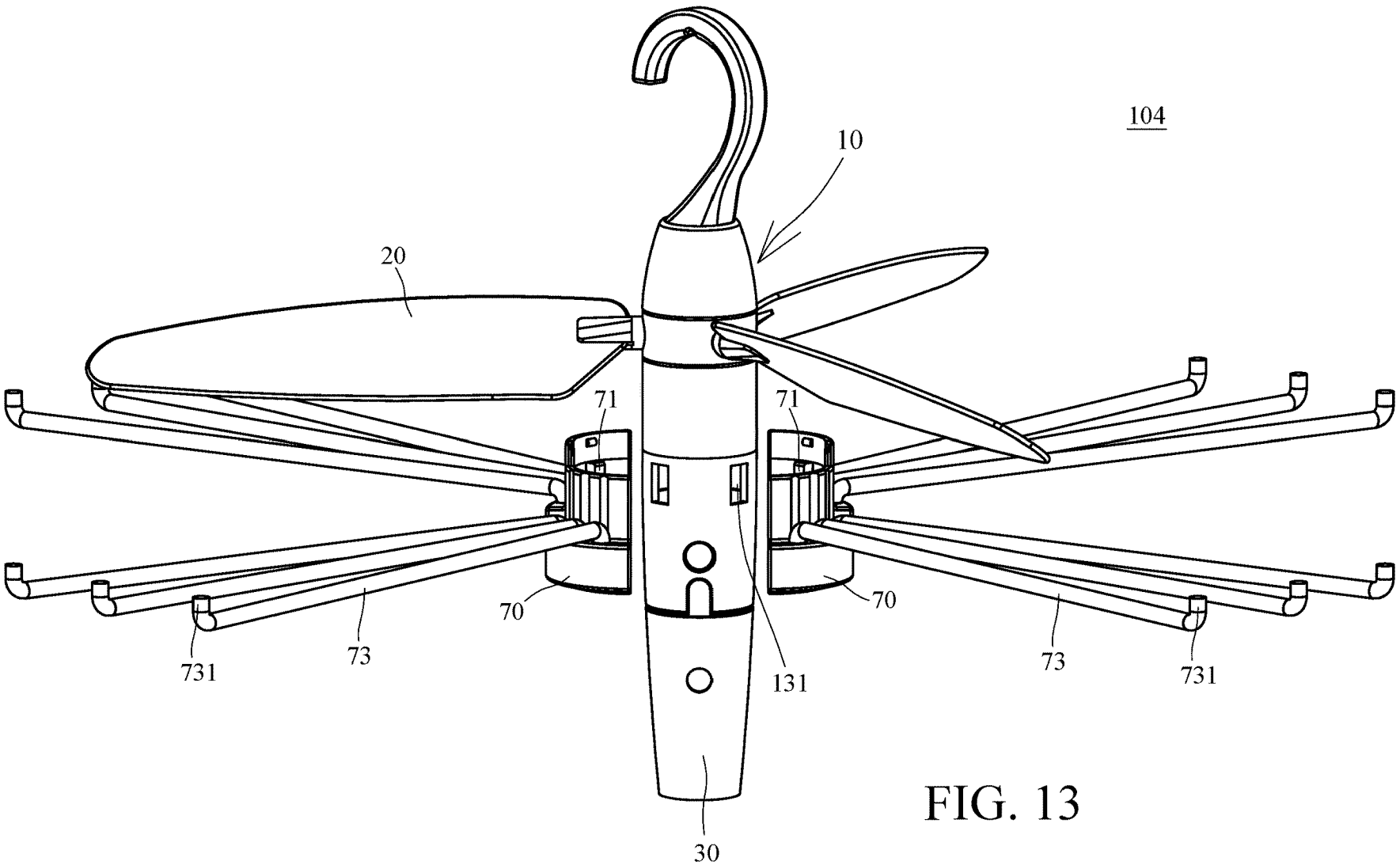
FIG. 13 is a perspective exploded view of support frames of a blowing device according to another embodiment of the invention.
Figure 14:
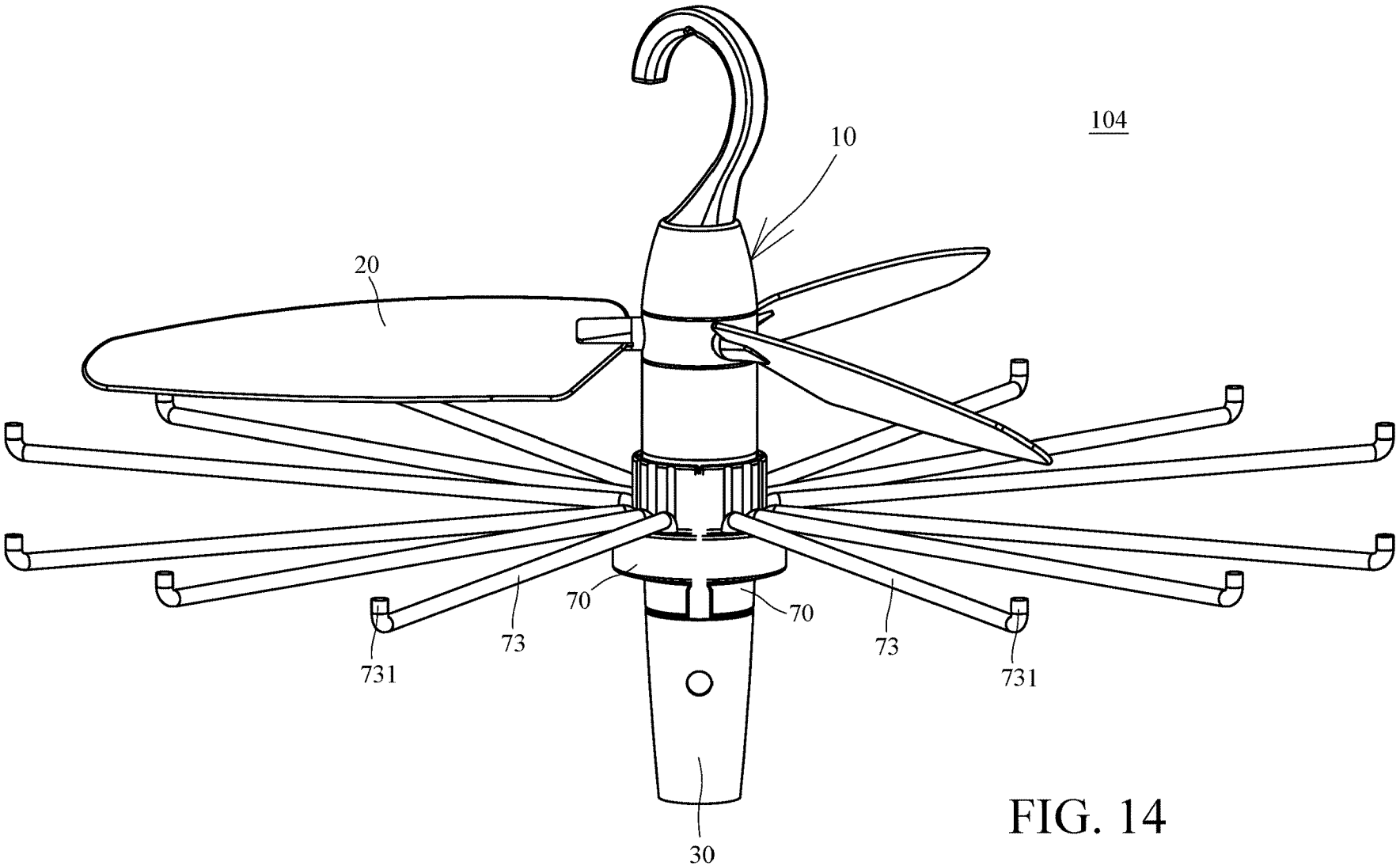
FIG. 14 is a perspective view of a blowing device according to another embodiment of the invention.
Figure 15:
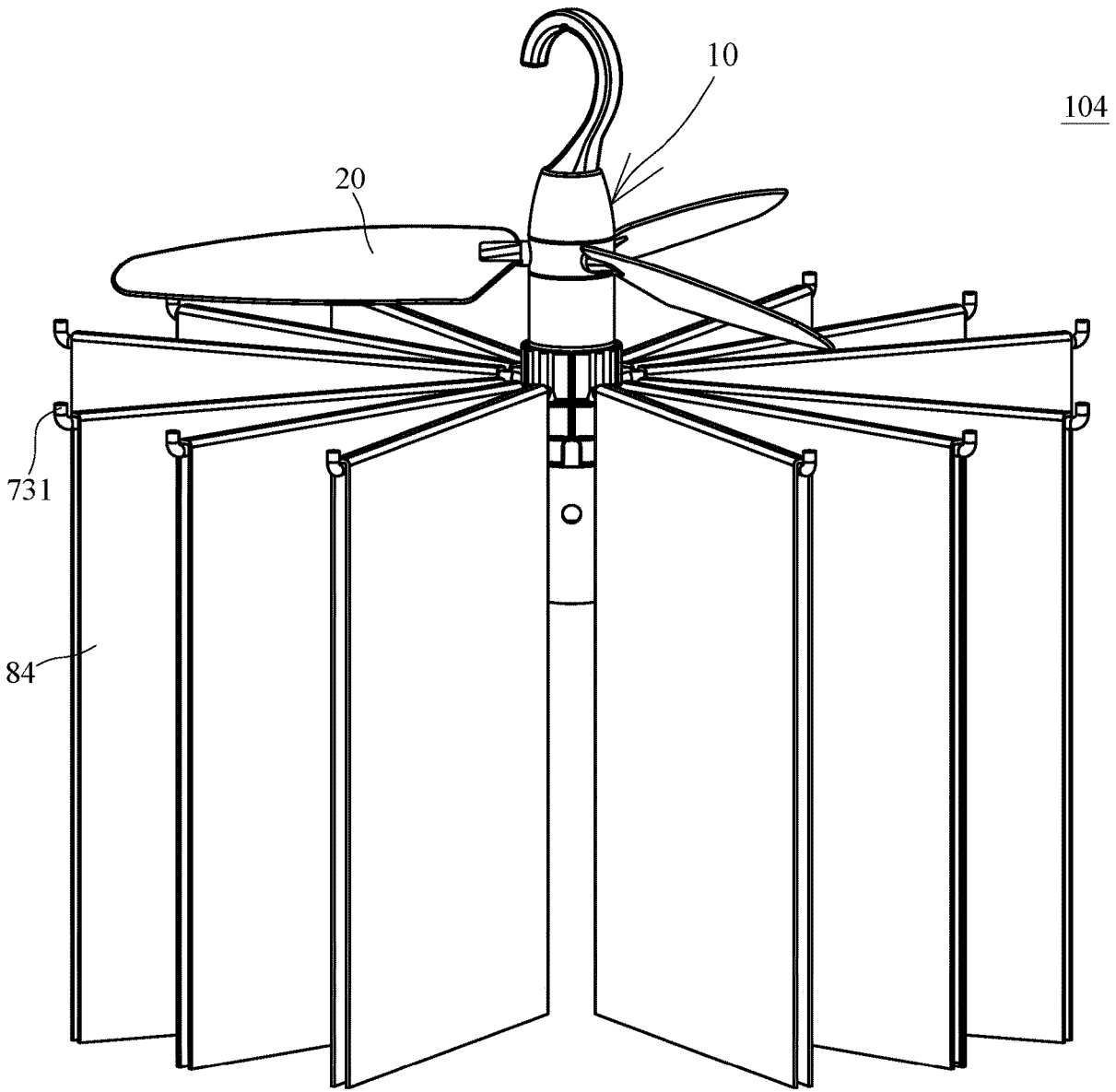
FIG. 15 is a use diagram of a blowing device according to another embodiment of the invention.

Please refer to FIG. 13, FIG. 14 and FIG. 15, which are respectively a perspective exploded view of support frames of a blowing device, a perspective view and a use diagram of a blowing device according to another embodiment of the invention. The blowing device of the invention may be used to blow and dry towels besides drying clothes, shoes and socks. The support frame 70 of the blowing device 104 of the embodiment may be an arc-shaped frame, wherein one side, such as an inner side or inner surface, of the arc-shaped support frame 70 is provided with at least one second connection portion 71, and the other side, such as an outer side or outer surface, is provided with at least one rod-shaped frame 73. One end of the rod-shaped frame 73 is connected to the arc-shaped support frame 70, and the other end of the rod-shaped frame 73 is provided with a raised stop portion 731. The second connection portion 71 of the arc-shaped support frame 70 may be inserted into the second fixed portion 131 of the lower rod portion 13. In one embodiment of the invention, a plurality of arc-shaped support frames 70, such as two or four arc-shaped support frames 70, are placed on the outer surface of the support rod 10 and forms an annular member.

In actual application, the towel 84 can be hung on the rod-shaped frame 73 of the arc-shaped support frame 70, and the blades 20 of the blowing device 103 can generate the airflow to blow the towel 84 on the rod-shaped frame 73 to reduce time of dry the towel 84.

The blades 20 and the arc-shaped support frame 70 of the blowing device 104 can be detached from the support rod 10, and the battery unit 30, the support rod 10, the blades 20, and the arc-shaped support frame 70 may be stored in the luggage bag. In other embodiment, the blades 20 may be connected to the first connection portion 21 via the rotating shaft 23, and the user can fold or rotate the blades 20 relate to the rotating ring 12 for storage of the blowing device 103 without removing the blades 20 from the support rod 10.

The blowing device of the present invention may be connected to various forms of support frame 40/50/60/70, and the user can select the appropriate support frame 40/50/60/70 to connect with the support rod 10 according to the items to be dried.

The invention provides a blowing device, the user is able to carry the blowing device while traveling, and can assemble or disassemble the portable blowing device at any time or place to blow and dry clothes.

The above disclosures are only the preferred embodiments of the present invention, and are not to be used to limit the scope of the present invention. All equivalent variations and modifications on the basis of shapes, structures, features and spirits described in claims of the present invention should be included in the claims of the present invention.

The invention claimed is:

1. A portable blowing device, comprising:

at least one support rod including an upper rod portion, a rotating ring and a lower rod portion, one end of said upper rod portion being connected with a hook, said rotating ring located between said upper rod portion and said lower rod portion, a plurality of first fixed portions being disposed on an outer surface of said rotating ring, and a housing space located in said lower rod portion for containing a battery unit; and a plurality of blades connected with said rotating ring, wherein one end of each blade has a first connection portion for connecting to said first fixed portion of said rotating ring, wherein said first connection portion is connected to said blades via a rotating shaft.

2. The blowing device of claim 1, comprising a plurality of support frames having a second connection portion disposed on one end thereof, and an outer surface of said lower rod portion having a plurality of second fixed portions for connecting to said second connection portion of said support frames respectively.

3. The blowing device of claim 2, wherein said support frame is a flat cuboid, and a plurality of grooves are located on a top surface of said support frame, or a plurality of through holes are located on a side surface of said support frame.

4. The blowing device of claim 3, wherein the other end of each said support frame comprises a connection recess or a connection projection for connecting to a support frame of another blowing device via said connection recess or said connection projection.

5. The blowing device of claim 2, wherein said lower rod portion of said support rod connects with two said support frames to form a hanger.

6. The blowing device of claim 5, further comprising an arcuate auxiliary support frame having a third connection portion at one end thereof, said third connection portion of said arcuate auxiliary support frame being connected to one of said second fixing portions of said lower rod portion, and angles between said arcuate auxiliary support frame and said two support frames being the same.

7. The blowing device of claim 2, wherein said support frame is a U-shaped support frame.

8. The blowing device of claim 2, wherein said support frame is an arc-shaped support frames, one end of a rod-shaped frame is connected to said outer surface of said arc-shaped support frames, and the other end of said rod-shaped frame is provided with a protruding stop portion.

9. The blowing device of claim 1, further comprising a through hole disposed on said lower rod portion of said support rod, and a protruding button disposed on said battery unit, wherein said battery unit is located in said housing space of said lower rod portion, and said protruding button is locked in said through hole.

10. The blowing device of claim 1, wherein said battery unit is a rechargeable battery.

11. The blowing device of claim 1, wherein said battery unit is a carbon zinc battery, an alkaline battery or a disposable battery.

* * * * *